US012245650B2

(12) United States Patent
Richardson

(10) Patent No.: US 12,245,650 B2
(45) Date of Patent: Mar. 11, 2025

(54) WEFTLOCK FOR HAIR STYLING AND WIG ASSEMBLIES

(71) Applicant: Ashia Lanae Richardson, Mechanicsburg, PA (US)

(72) Inventor: Ashia Lanae Richardson, Mechanicsburg, PA (US)

( * ) Notice: Subject to any disclaimer, the term of this patent is extended or adjusted under 35 U.S.C. 154(b) by 238 days.

(21) Appl. No.: 17/300,969

(22) Filed: Dec. 28, 2021

(65) Prior Publication Data

US 2023/0200475 A1 Jun. 29, 2023

(51) Int. Cl.
*A41G 3/00* (2006.01)

(52) U.S. Cl.
CPC ..... *A41G 3/0033* (2013.01)

(58) Field of Classification Search
CPC .. A41G 3/0008; A41G 3/0033; A41G 5/0073; A41G 5/0086; B65D 63/1027;
(Continued)

(56) References Cited

U.S. PATENT DOCUMENTS 3,809,100 A 5/1974 Salvatore
3,874,034 A * 4/1975 Clayton ..... B65D 63/1027 383/62

(Continued)

FOREIGN PATENT DOCUMENTS

JP 2004091972 3/2020

OTHER PUBLICATIONS

JP2004091972 Imaizumi Hiroto, Problem to Be Solved: To provide a wig for fashion in high demand of a woman, enabling various kinds of hair styles to be easily produced according to a time, a site and a scene, and facilitating the attaching and detaching. Solution: The wig is constituted of the first wig and the second wig. The first wig has a base body in a cap shape, imitation hairs planted on the surface of the base body, a first clip clipped on the self hair, installed in a part at the back side of the base body, facing to the vicinity of the forehead part of the head, and a second clip clipped on the self hair, installed in a part at the back side of the base body, facing to the vicinity of the back of the head. The second wig has a base body, imitation hairs planted on the surface of the base body, a third clip clipped to the self hair, installed in the upper end part of the back side of the base body, engaging the self hair, and attached to the second clip clipped on the self hair of the first wig so as to be freely detachable. If necessary, one of the first and second wigs, or both of the first and second wigs in a joined state are worn to enable the usage form to be set freely, Aug. 30, 2002, Mar. 25, 2004.

*Primary Examiner* — Rachel R Steitz
(74) *Attorney, Agent, or Firm* — Powell Law PC; Mary H Powell, Esq

(57) ABSTRACT

A hairstyling weftlock is provided which consists of a narrow band having opposing ends consisting of a locking mechanism at one end and a threading portion. Upon threading the threading portion through the locking mechanism, the locking mechanism is able to secure the threading portion at a desired length along the threading portion. The weftlock of the current invention may satisfy a connective function in the fabrication of a wig assembly or may be utilized to sheave strands of hair of a hairstyle client by connecting wefts of hair to other hair, including human hair and hair styled in braids, twists or cornrows and wig assembly cornrows, as well as facilitate the installation of braid extensions.

5 Claims, 6 Drawing Sheets

(58) Field of Classification Search
CPC ..... B65D 63/1036; B65D 63/1045; B65D 63/1054; B65D 63/1063; B65D 63/1072; B65D 63/1081
See application file for complete search history.

(56) References Cited

U.S. PATENT DOCUMENTS

| | | | | |
|---|---|---|---|---|
| 4,830,029 | A | 5/1989 | Bird | |
| 5,493,735 | A | 2/1996 | Rice | |
| 5,501,239 | A | 3/1996 | Walker | |
| 5,657,774 | A | 8/1997 | Niese | |
| 6,662,806 | B2 | 12/2003 | Nakane | |
| 10,575,576 | B2 | 3/2020 | Hayes | |
| 10,750,809 | B2 | 8/2020 | Kim | |
| 10,755,603 | B1 | 8/2020 | Truong | |
| 2001/0013351 | A1 | 8/2001 | Tang | |
| 2002/0166565 | A1 | 11/2002 | Whitfield | |
| 2008/0047572 | A1 | 2/2008 | Park | |
| 2010/0037908 | A1 | 2/2010 | Hatcher | |
| 2013/0333163 | A1* | 12/2013 | Chen | B65D 63/1027 24/16 PB |
| 2015/0327611 | A1 | 11/2015 | Kleinman | |
| 2016/0143643 | A1* | 5/2016 | Smith | A61B 17/068 606/139 |
| 2016/0262482 | A1 | 9/2016 | Kim | |
| 2019/0053795 | A1* | 2/2019 | Asfora | A61B 17/06 |

* cited by examiner

WEFTLOCK FOR HAIR STYLING AND WIG ASSEMBLIES

FIELD OF THE INVENTION

The present invention relates to hair styling accessories, wigs, apparatus to fabricate wigs, and methods of styling hair and fabricating wigs.

BACKGROUND OF THE INVENTION

Virtually all methods of installing hair extensions or creating wigs involve attaching hair by using either knotting, twisting or braiding the hair, or attaching hair with the assistance of temporary clips, flexible bands, adhesive techniques and, most popular, needle and thread. It is not uncommon for a hair extension Installation to take four or more hours. As well, making a wig, whether by hand or with the use of a sewing machine, generally takes several hours, sometimes even days. Regarding a needle and thread, positioning a thread through the tiny eye of a needle can present a great challenge.

Often a wig fabricator or beautician installing a hair extension will experience fatigue in the arms, muscle tightness in the shoulders and cramps in the fingers after pulling a needle and thread through a client's hair repeatedly for hours. Utilizing a sewing machine to construct a wig can often be difficult and tedious. The unpleasant nature of the above noted endeavors is multiplied if the wig fabricator or beautician suffers from a physical ailment such as arthritis, failing eyesight or some other health condition. During the installation of a hair extension on the head of a beautician's client, the client often experiences pain due to the necessary and constant pulling and tightening of the client's hair immediately adjacent to and extending from the client's scalp in the course of the beautician employing the needle and thread techniques for securing the hair extension. Further, there is the possibility of scalp punctures caused by a needle.

The use of rubber bands for hair styling damages the hair since rubber bands aggressively pull the hair to cause tension. Such aggressive pulling of the hair weakens the hair shafts, which results in hair breakage and, overtime, balding. There is the need for a method of preventing rubber band damage due to collecting hair strands into sheaves.

It is furthermore desirable to maintain hair "fullness" without using hairspray, hair lacquer, spritz, gel or other chemicals. Hairspray is used to stiffen and add "fullness" to the volume of hair. Hairspray generally consists of chemicals in the form of concentrate, plasticizers, luster agents, fragrances, propellants and other chemicals. In the year 1968 at the feminist Miss America protest, protestors symbolically threw a number of feminine products into a "Freedom Trash Can." Those products included hairspray, which was among the items the protestors called "instruments of female torture." (Dow, Bonnie J (Spring 2003) "Feminism, Miss America, and Media Mythology". Rhetoric & Public Affairs 6(1): 127-149).

Many individuals are allergic to certain chemical propellants and solvents used in hairsprays. Others do not prefer hairsprays because they think any benefits from hairspray are outweighed by the possible adverse impact on the environment due to the manufacturing, use or disposal of hairspray or aerosol hairspray containers.

In addition, wigs are quite popular at this time, regardless of the wearer's age. Babies are prone to come in contact with hair on or hanging from their mothers' heads. These mothers desire to wear wigs that do not contain chemicals associated with hairspray. Hair fullness is desired while minimizing the need for hairspray.

Moreover, there is a demand for an invention that has the sturdiness to assist in aerating the scalp of a wig wearer. Even though wigs are extremely popular, in warm climates, the close proximity of a wig to a scalp results in limited ventilation for the scalp. A technique is desired that causes limited tension and assists a wig wearer in promoting ventilation by lifting hair away from the scalp.

It is desirable to provide a method and apparatus that eliminates many of the difficulties and inconveniences associated with attaching hair extensions and the fabrication of wigs, that also provides hair fullness and aerates the scalp.

SUMMARY OF THE INVENTION

To make manifest the above noted and other manifold desires, a revelation of the present invention is brought forth. The present invention, in one preferred embodiment, endows a freedom of a weftlock consisting of a narrow band having opposing ends consisting of a locking mechanism at one end and a threading portion at the opposing end of the weftlock. The threading portion of the weftlock may also have a rack segment positioned along the threading portion. Threading the threading portion through the locking mechanism enables the locking mechanism to secure the threading portion at a desired length of the threading portion. Furthermore, in a preferred embodiment of the present invention, the locking mechanism of the weftlock has a height less than four times the height of the threading portion and wherein an extreme end of said threading portion is a sharpened needle end. The weftlock of the current invention may satisfy a connective function, by way of examples, to fabricate a wig assembly; to connect wefts to cornrows of a wig assembly; to sheave strands of hair of a hairstyle client to facilitate the installation of braid extensions; or to connect wefts to natural strands of hair.

Further areas of applicability of the present invention will become apparent from the detailed description provided hereinafter. It should be understood that the detailed description and specific examples, while indicating the preferred embodiment(s) of the invention, are intended for purposes of illustration only and are not intended to limit the scope of the invention.

DETAILED DESCRIPTION OF THE PREFERRED EMBODIMENTS

The following description of the preferred embodiment(s) is merely exemplary in nature and is in no way intended to limit the invention, its application or uses.

Figure 1:
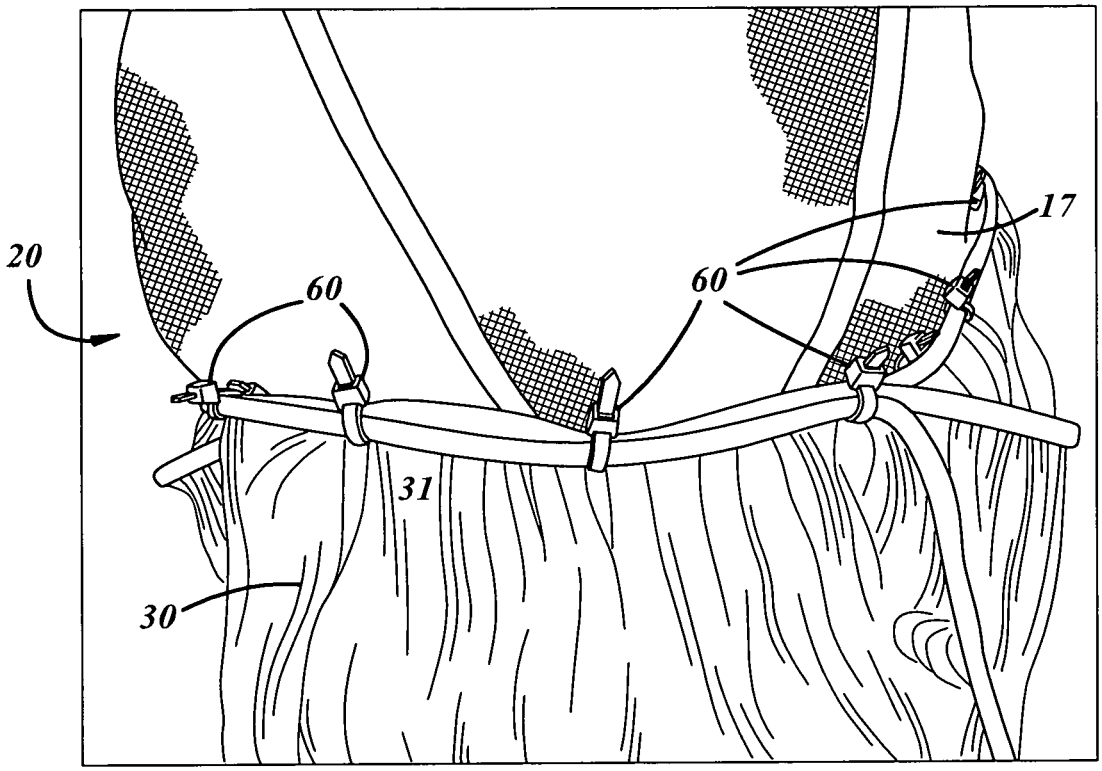
FIG. 1 is a rear perspective view of a fabrication of a wig assembly according to the present invention that includes a cap, a hairpiece such as a human or artificial hair weft, and a weftlock.
Figure 2:
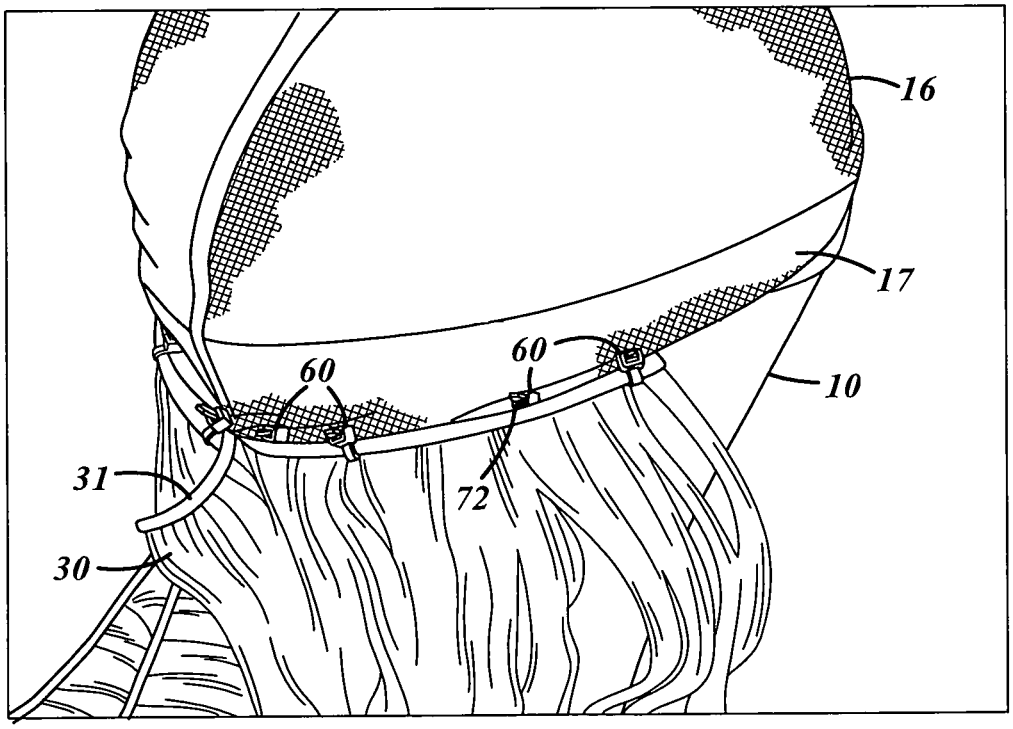
FIG. 2 is a view from the side rear perspective of the wig assembly shown in FIG. 1.
Figure 3:
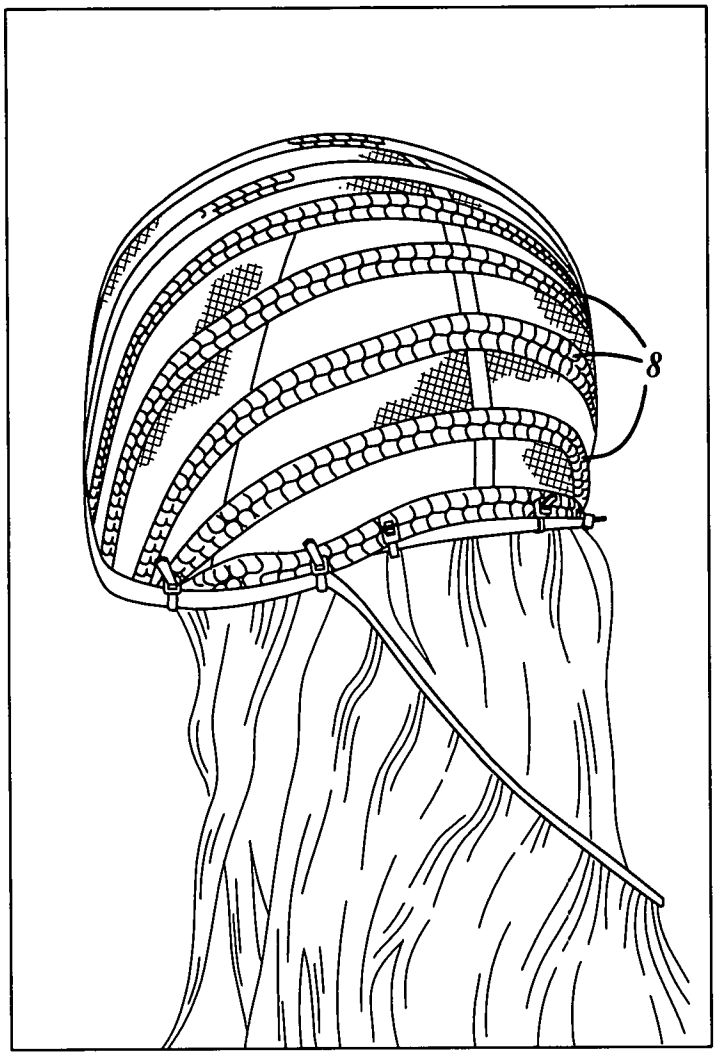
FIG. 3 is a view similar to FIG. 1 of an alternate preferred embodiment wig assembly according to the present invention having a cap that additionally has cornrows.

Referring to FIGS. 1 through 7, a wig assembly production apparatus 7 is provided. The wig production apparatus 7 has a mannequin head 10. The mannequin head 10 has a crown for positioning a cap 16 of a wig assembly 20. The cap 16 of the wig assembly 20 is typically provided by a semi-mesh fabric material and often has a form of elasticity or elastic band 17 adjacent its peripheral edge. When in use, the cap 16 is fitted on the crown of a wearer's head. The cap 16 can optionally be provided with cornrows 8. As used herein, the term "cornrow 8" refers to braided hair that is oriented along the scalp rather than braided hair that projects away from the scalp, or braided hair that is oriented along the cap 16 rather than projecting away from the cap 16. The cap 16 provides a base structure for hair positioned on the wig assembly 20. In FIGS. 1 through 3, the cap 16 is shown without top hair for clarity of illustration. The hair attached to the cap 16 may be human hair or may consist of a synthetic material. The hair may be attached to the cap 16 by a plurality of means such as knotting, twisting or braiding the hair, or with the assistance of clips, flexible bands, sewing, an adhesive technique, or as in techniques explained hereinafter.

Connected preferably along a cornrow 8 of the cap 16 of the wig assembly 20 is at least one hairpiece such as a sheave 92 of hair strands, a braid, or a weft 30. The weft 30 is fabricated from strands of hairs that are joined to one another at one extreme end of each of the strands of hairs by a fabric weave 31. The hair of the weft 30 may be human hair or synthetic hair. Typically, a plurality of wefts 30 is used to complete the wig assembly 20. The use of wefts 30 allows a plurality of wig assembly 20 sizes or styles to share a common cap 16. For a wig assembly 20 styled into a short hairstyle, the weft 30 has shorter hair. For a wig assembly 20 styled into a long hairstyle, the weft 30 has longer hair. Additionally, wefts 30 can be changed to provide the wig assembly 20 with different hair textures, curl intensity, color(s) or density while still retaining the common cap 16.

Figure 4:
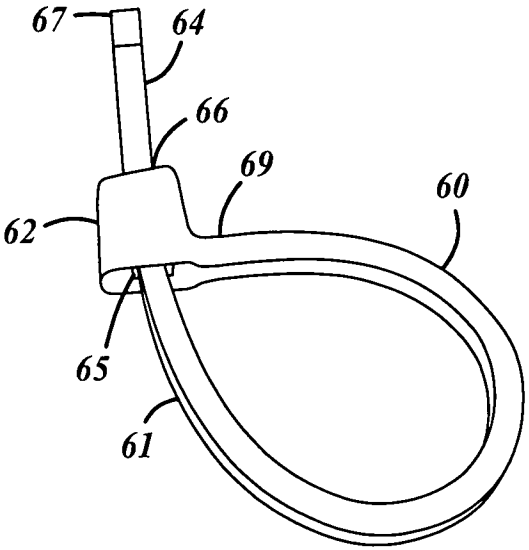
FIG. 4 is a side perspective view of an inventive weftlock of the present invention.

Connecting one or more wefts 30 to the cap 16 requires at least one, and often a plurality of, weftlocks 60. A weftlock 60 is provided by the nature of a cable-lock type connector. A preferred embodiment of the weftlock 60 is fabricated from a molded polymeric material such as polyethylene, platinum silicone, silicone rubber, bioplastics and nylon, as well as bamboo, beeswax-coated fabric, elastomeric material and other suitable materials. While other sizes can be used for functional and decorative purposes, as shown in FIG. 4, the weftlock 60 is a narrow band (preferably 1.3 mm or less) having a block shaped locking mechanism 62. The locking mechanism 62 has a rectangular through opening 66 with a pawl positioned thereon (typically internally).

Figure 5:
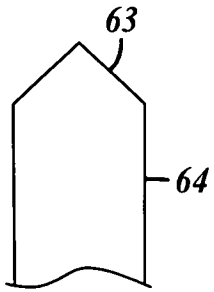
FIG. 5 is a partial top elevational view of a threading portion of a weftlock shown in FIG. 4.

Integrally extending from, and opposite of, the locking mechanism 62 is a planar threading portion 64. The threading portion 64 has a preferable width of 1.3 mm or less and a length of 60 mm or less. The threading portion 64, as shown in FIGS. 4 and 5, has a rectangular cross section slightly smaller than the through opening 66 in the locking mechanism 62. Along the threading portion 64 major cross-sectional dimension, the threading portion 64 has a rack segment formed by protrusions, depressions or apertures in the threading portion 64 for engagement with the pawl of the locking mechanism 62.

The threading portion 64 of the weftlock 60 has a needle end 63 formed into a sharpened tip in order to enhance the effectiveness of the weftlock 60. Preferably the sharpened tip of the needle end 63 of the threading portion 64 has a radius of curvature smaller than 0.2 mm. Threading the needle end 63 of the threading potion 64 through the through end 65 of the through opening 66 in the locking mechanism 62 secures the weftlock threading portion 64 at a desired position along the threading portion 64 to form an adjustable length loop 61 captively connecting the weft 30 to the cap 16. A height of the locking mechanism 62 is preferably less than four times a height of the weftlock threading portion 64.

The needle end 63 of the threading portion 64 of the weftlock 60 facilitates threading the threading portion 64 of the weftlock 60 through hair, as well as threading the threading portion 64 of the weftlock 60 through the locking mechanism 62 via the through opening 66. Additionally, the needle end 63 of the threading portion 64 can be utilized to form and penetrate a perforation 72 in the cap 16. Optionally, the needle end 63 can also be utilized to thread the threading portion 64 through the fabric weave 31 of the weft 30. The cap 16 optionally can have a series of preformed slots or perforations to facilitate penetration of the weftlock threading portion 64 through the cap 16 material.

Figure 14:
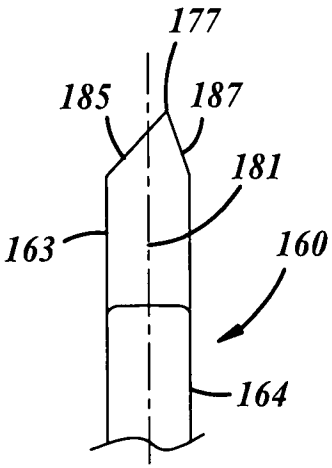
FIG. 14 is a view similar to that of FIG. 5 of an alternate preferred embodiment weftlock having a composite threading portion with a needle end with an asymmetrical end tip.

In the embodiment shown in FIG. 14, a weftlock 60 with a composite threading portion 64 has a needle end 63 made of a differing cellulosic, polymeric or metallic material to that of the remainder of the threading portion 64. The needle end 63 forms a sharpened tip 177 in order to enhance the effectiveness of the weftlock 160. Optionally the tip 177 can be formed asymmetrically by being transversely offset from a centerline of the threading portion 64. The asymmetric nature of the tip 177 can also be supplied by the angle of the tip 177 differing from side to side. For instance, a side angle can be 45 degrees while the other tip 177 angle can be 30 degrees or even zero degree. The tip 177 may be doubly asymmetric by being laterally offset from a threading portion 64 centerline and having differing angles from side to side.

Figure 11:
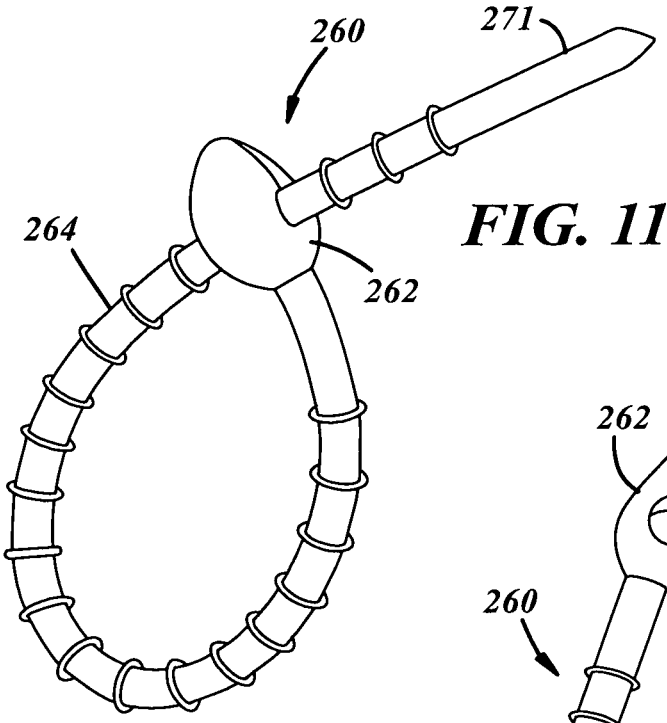
FIG. 11 is a side perspective view similar to that of FIG. 4 of an alternate preferred embodiment elastomeric weftlock of the present invention.
Figure 12:
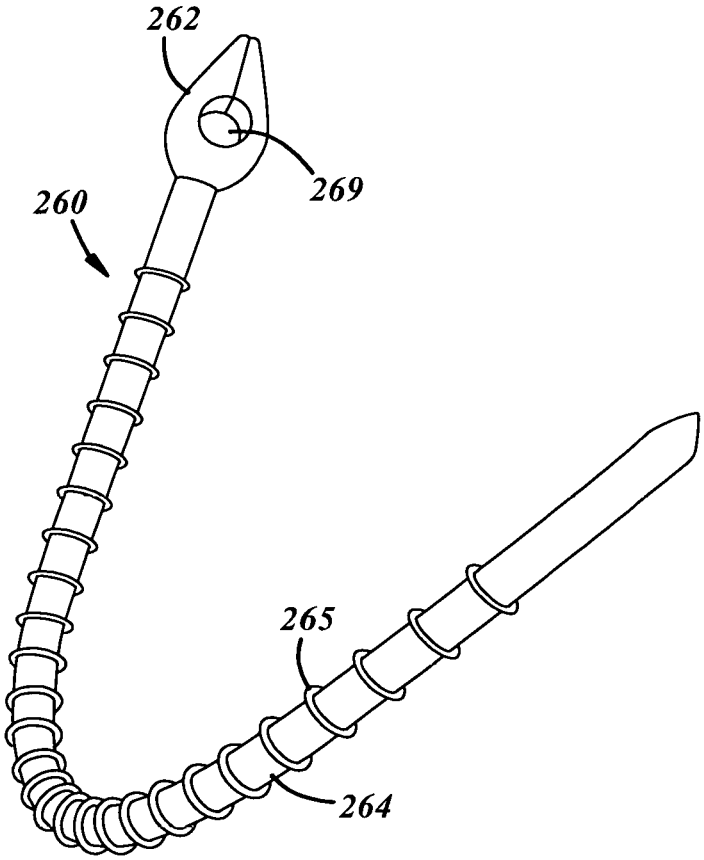
FIG. 12 is a perspective view of a threading portion of the weftlock shown in FIG. 11 prior to a threading operation.
Figure 13:
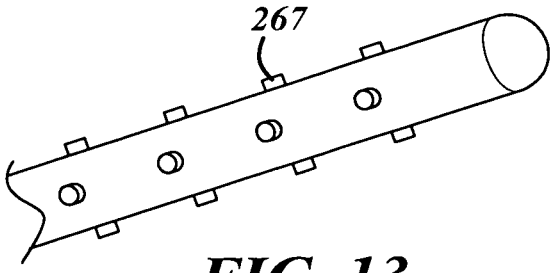
FIG. 13 is partial view of an alternate preferred embodiment elastomeric weftlock shown in FIG. 12.

FIGS. 11-13 illustrate an alternative embodiment weftlock 260 wherein the weftlock 260 is fabricated from an elastomeric material and the threading portion 264 has protrusions taken from a group of axially spaced projections 267 (FIG. 13) or radial rims 265 (FIG. 12). Upon inserting the threading portion 264 of the weftlock 260 into the locking mechanism 262 of the weftlock 260, the needle end 264 adheres to the locking mechanism 262.

The mannequin head 10 can have symbolic, color, surface, protrusions, or depression markings 12 to aid the wig assembly 20 assembler to properly position the cap 16 of a predetermined style or size on the mannequin head 10. In similar manner, the cap 16 may have symbolic or color marking to coordinate with the markings of the mannequin head 10. Further, the mannequin head 10 can have symbolic, color, surface, protrusions, or depression markings 13 to aid the wig assembly 20 assembler to properly position the weft 30 in relationship to the cap 16, and to also designate proper locations wherein weftlocks 60 should be utilized to connect the weft 30 to the cap 16. Furthermore, the mannequin head 10 can have depressions 14 that redirect the needle end 63 of the weftlock threading portion 64 outward to encircle the fabric portion of the weft 30 to the cap 16.

In operation, the wig assembler places the cap 16 on a wig wearer's head or on a mannequin head 10. The wig assembler will inspect the alignment of the wig assembly 20 on the mannequin head 10 or the wearer's head. The wig assembler will then align the weft 30 in a manner consistent with the cap 16. Then, the wig assembler will utilize the weftlocks 60 (of the desired color, and decorative or ornamental design) to connect the wefts 30 to the cap 16. Thereafter, generally, the wig fabricator or beautician will utilize some type of cutting tool to remove any length of the threading portion 64 of the weftlock 60 considered access. The process is repeated until the desired hairstyle is achieved.

Referring to FIG. 3, the weftlock 60 can be utilized to attach a weft 30 to a cornrow 8 of a hairstyle client or to a cornrow 8 of the wig cap 16. The needle end 64 of the weftlock 60 can be used to penetrate the cornrow 8 or to go under the cornrow 8 to secure the weft 30 to a hairstyle client's cornrow 8 or to a cornrow 8 of a wig cap 16. The needle end 63 of the weftlock threading portion 64 can also penetrate the fabric weave 31 of the weft 30 or can encircle the fabric weave 31 when securing the weft 30 to the cornrow 8.

Figure 7:
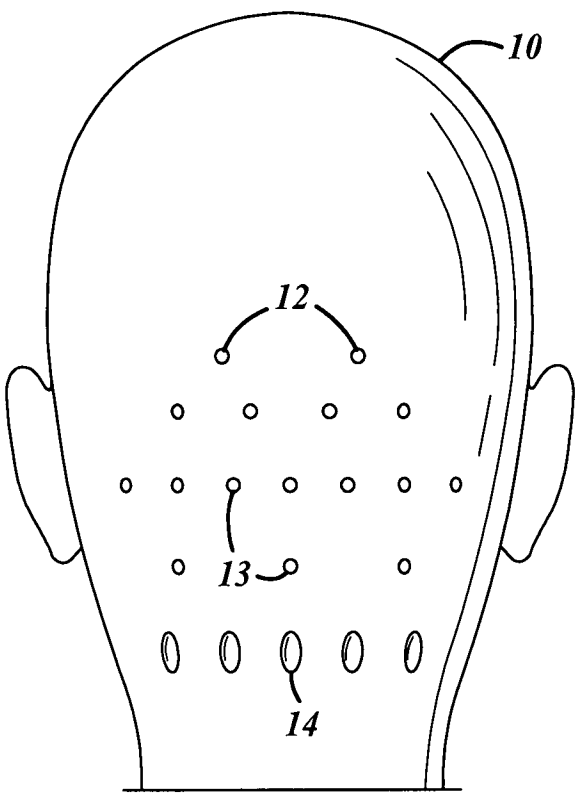
FIG. 7 is a rear schematic view of the mannequin head shown in FIG. 6.
Figure 6:
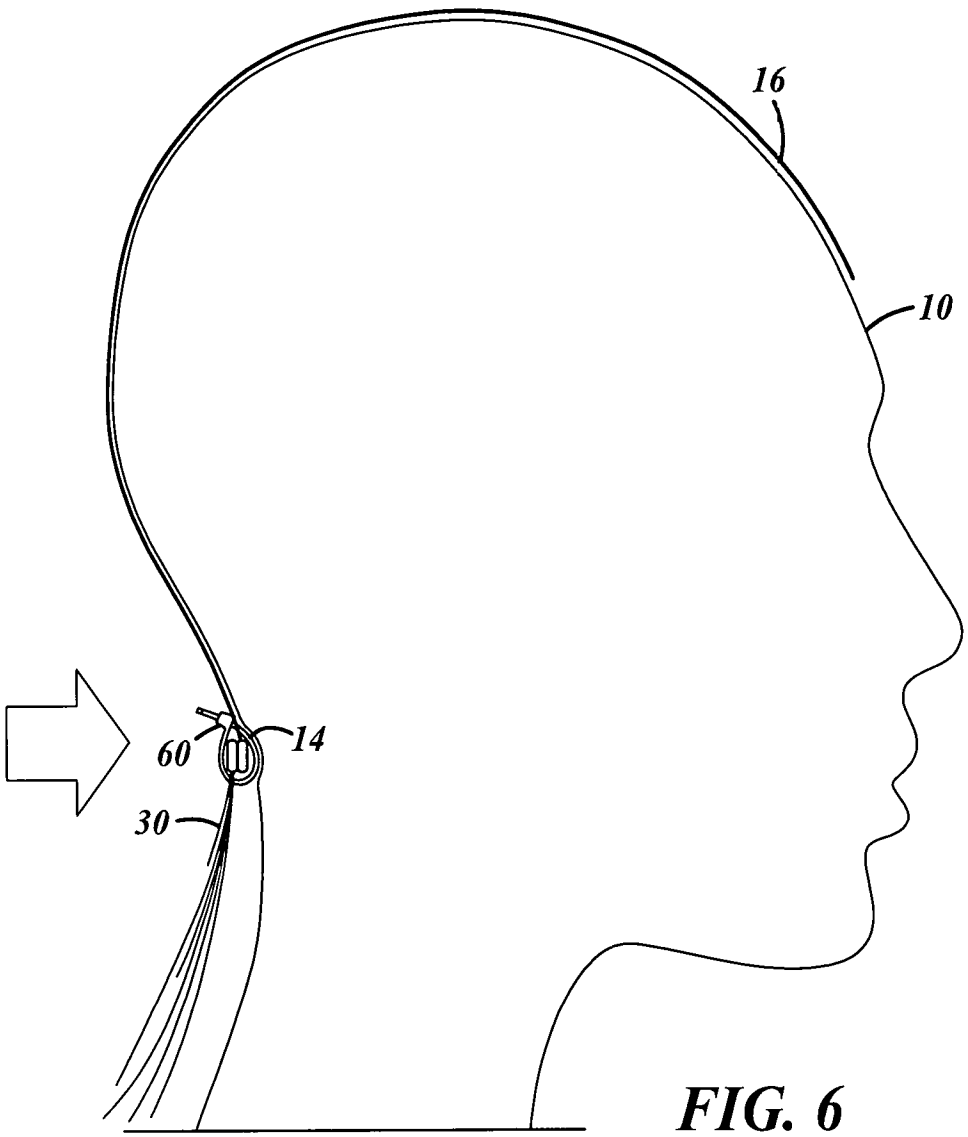
FIG. 6 is a side schematic view of a mannequin head utilized in the wig fabrication assembly according to the present invention.
Figure 8:
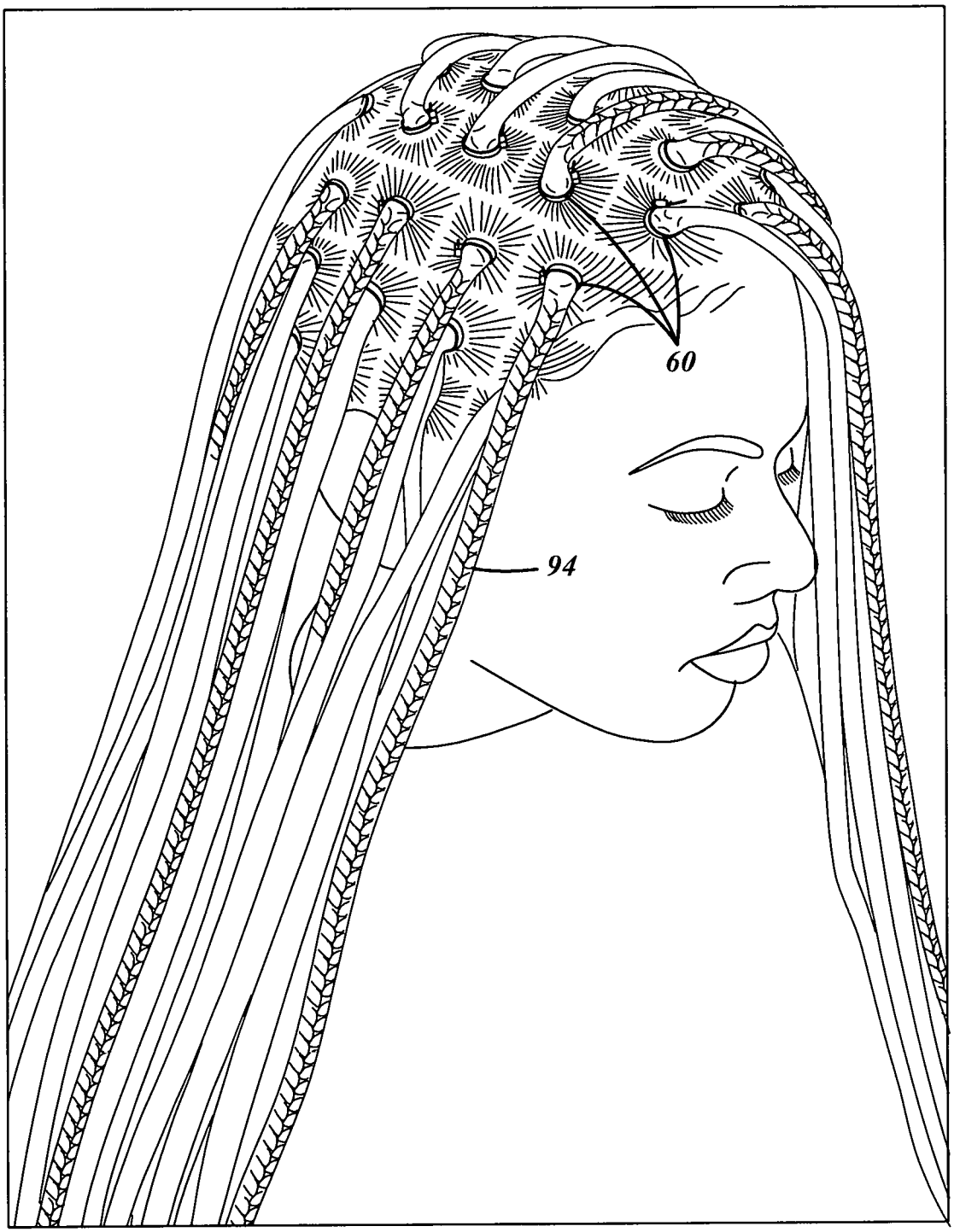
FIG. 8 is a perspective view of a hairstyle client having braid extensions utilizing the weftlock shown in FIG. 4.
Figure 9:
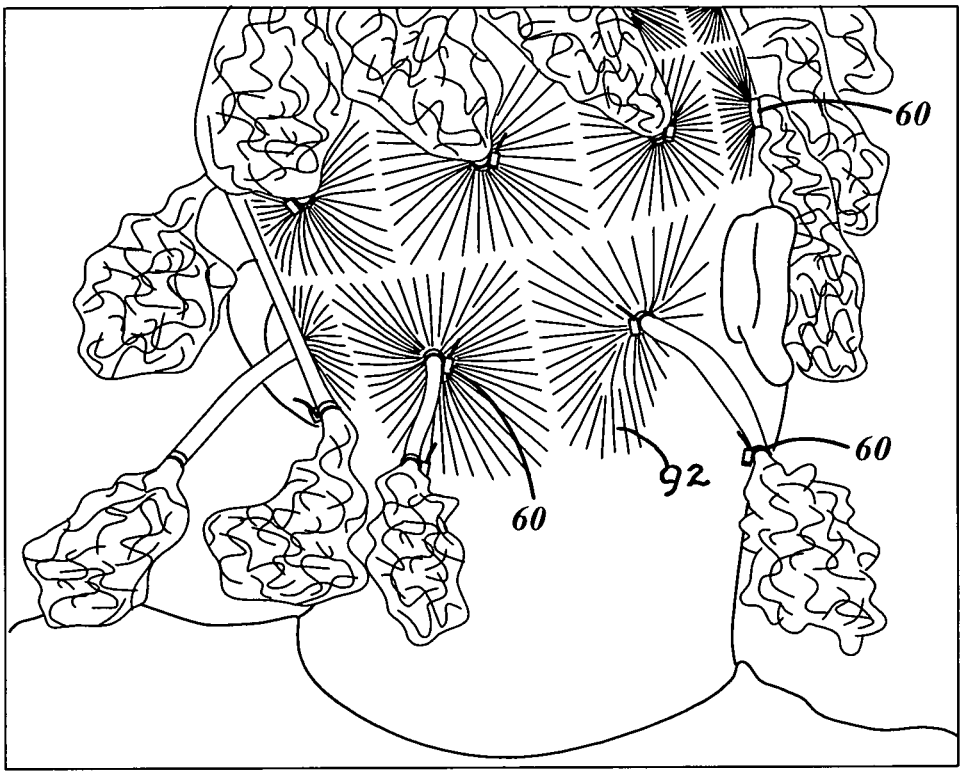
FIG. 9 is a rear perspective view of a hairstyle client showing preparation for braid extensions utilizing the weftlock of FIG. 4 on sheave strands of hair.
Figure 10:
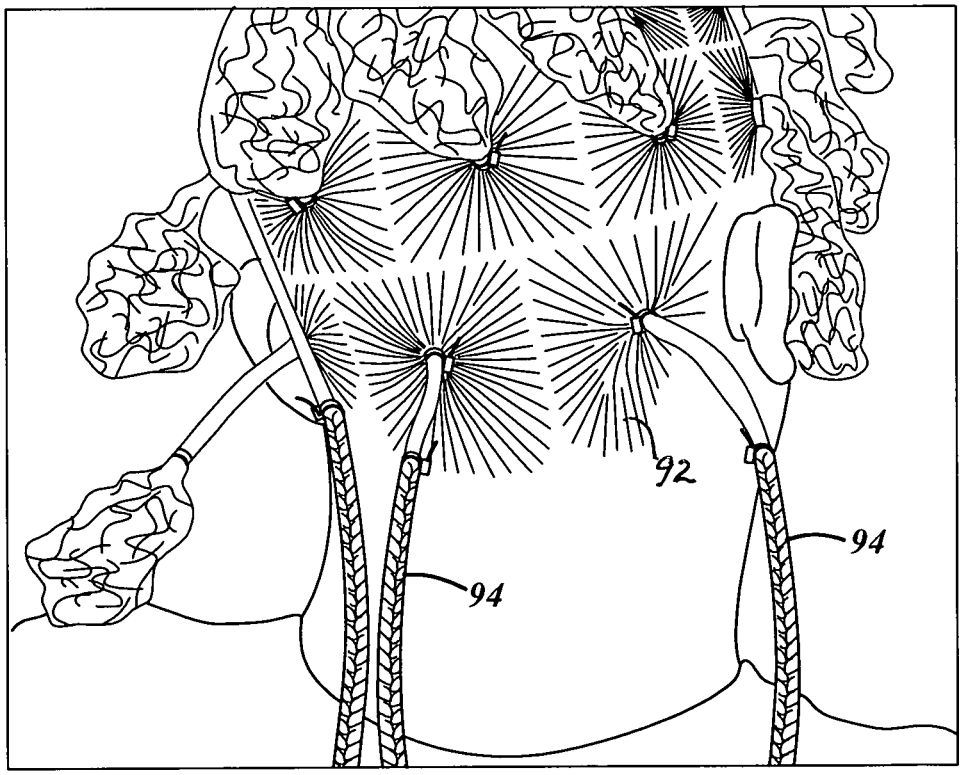
FIG. 10 is a rear perspective view of the hairstyle client shown in FIG. 9 after braid extensions have been applied to the sheaves of hair strands shown in FIG. 8.

In still another application employing the inventive weftlock 60 of the present invention shown in FIGS. 7-9, hair strands (hair shafts) are separated into sections such as squares or blocks. Weftlocks 60 are utilized to collect hair strands into sheaves 92 (best shown in FIGS. 9 and 10). The sheaves 92 are then interwoven with hair extensions such as a braid extension 94 of the Fulani type. (See FIGS. 8 and 10 for two examples). An advantage of the use of the weftlocks 60 in forming the sheaves 92 is that the weftlocks 60 do not have the degree of expansion as the prior art of rubber bands. The firmness of the weftlock 60 reduces the frequency the hairstyle client must return to the hair salon for a hairstyle "touch-up." By way of example, use of the weftlock 60 reduces the need to retighten braid extensions.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A weftlock comprising:

a locking mechanism having a rectangular through opening with a pawl positioned thereon, the locking mechanism having a proximal end opposite a distal end, where the distal end of the locking mechanism defines a distal end of the weftlock;

a threading portion integrally extending from the proximal end of the locking mechanism, the threading portion having a rectangular cross-sectional dimensioned slightly smaller than the through opening in the locking mechanism, and a needle end extending from a proximal end of the threading portion, opposite the locking mechanism, where the needle end tapers to a point;

wherein the point of the needle end is sharpened and the needle end is made of a metallic composition to facilitate manually threading the weftlock through a cornrow and/or fabric weave, and the threading portion is made of a composite material different than the metallic composition of the needle end;

wherein during use, the needle end is threaded through the opening of the locking mechanism and the threaded portion is advanced through the opening of the locking mechanism to form an adjustable loop.

2. The weftlock according to claim 1, the locking mechanism and the threading portion are composed of an elastomeric material.

3. The weftlock according to claim 1, wherein the needle end is asymmetrically sharpened by being transversely offset from a centerline of the threading portion whereby the weftlock is configured to adaptively connect wefts to natural hair.

4. The weftlock according to claim 1, wherein the needle end is doubly asymmetric by being laterally offset form a threading portion centerline and having differing angles from side to side.

5. The weftlock according to claim 1, wherein said weftlock has protrusions taken from a group of axially spaced projections or radial rims, such protrusions or radial rims extending beyond the cross-sectional dimension of the threading portion.

* * * * *